US008471150B2

(12) United States Patent
Emilsson et al.

(10) Patent No.: US 8,471,150 B2
(45) Date of Patent: Jun. 25, 2013

(54) HIGH VOLTAGE DEVICE

(75) Inventors: David Emilsson, Ludvika (SE); Ralf Hartings, Ludvika (SE); Tommy Larsson, Ludvika (SE)

(73) Assignee: ABB Technology Ltd. (CH)

( * ) Notice: Subject to any disclaimer, the term of this patent is extended or adjusted under 35 U.S.C. 154(b) by 419 days.

(21) Appl. No.: 12/818,658

(22) Filed: Jun. 18, 2010

(65) Prior Publication Data

US 2010/0319955 A1 Dec. 23, 2010

(30) Foreign Application Priority Data

Jun. 18, 2009 (EP) ..... 09163088

(51) Int. Cl.

| | |
|---|---|
| ***H01B 17/28*** | (2006.01) |
| *H01B 17/26* | (2006.01) |
| *H01B 17/46* | (2006.01) |
| *H01T 4/14* | (2006.01) |

(52) U.S. Cl.

USPC ..... 174/143; 174/142; 174/140 R; 174/144

(58) Field of Classification Search

USPC ..... 174/142, 137 R, 140 R, 140 CR, 174/145, 73.1, 80, 81, 74 R, 14 R, 14 C, 174/14 CR, 102 SC, 105 SC, 106 SC, 110 SC, 174/11 S, 73 SC, 128.1, 128.2, 128 F, 152 G, 174/152 R, 153 G, 209, 75 R, 75 D, 135, 174/144, 141 R, 140 H, 11 BH, 12 BH, 19, 174/127, 14 BH, 143, 650, 18, 77 R, 76, 174/DIG. 8, 31 R; 385/138; 337/202; 428/389, 428/416, 418, 450, 463; 423/622; 523/459; 524/432; 264/230; 16/2.1, 2.2; 336/174, 70, 336/94; 248/56; 439/604, 587, 274, 275

See application file for complete search history.

(56) References Cited

U.S. PATENT DOCUMENTS

| | | | | |
|---|---|---|---|---|
| 3,659,033 | A * | 4/1972 | Grimmer | 174/15.3 |
| 5,198,622 | A * | 3/1993 | Hammarsten et al. | 174/143 |
| 6,951,987 | B1 * | 10/2005 | Hansen et al. | 174/142 |

FOREIGN PATENT DOCUMENTS

| | | | |
|---|---|---|---|
| EP | 1798740 | A1 | 6/2007 |
| WO | 2008027004 | A1 | 3/2008 |

OTHER PUBLICATIONS

European Search Report; EP 09 16 3088; Nov. 5, 2009; 6 pages.

* cited by examiner

*Primary Examiner* — Hoa C Nguyen
*Assistant Examiner* — Binh Tran
(74) *Attorney, Agent, or Firm* — St. Onge Steward Johnston & Reens LLC

(57) ABSTRACT

The invention relates to a high voltage device for providing electrical insulation of a conductor extending through the device. The device includes a hollow insulator; a conductor extending through the hollow insulator; a field gradient decreasing arrangement including a condenser core and a voltage grading shield. The condenser core and the voltage grading shield are arranged around the conductor inside the hollow insulator in a manner so that the voltage grading shield is arranged around at least part of the condenser core.

12 Claims, 6 Drawing Sheets

HIGH VOLTAGE DEVICE

CROSS-REFERENCE TO RELATED APPLICATIONS

The present application claims priority of European patent application No. 09163088.9 filed on Jun. 18, 2009, the content of which is incorporated herein by reference.

FIELD OF THE INVENTION

The present invention relates to the field of high voltage technology, and in particular to high voltage devices, such as bushings, for providing electrical insulation of a conductor.

BACKGROUND OF THE INVENTION

High voltage bushings are used for carrying current at high potential through a plane, often referred to as a grounded plane, where the plane is at a different potential than the current path. Bushings are designed to electrically insulate a high voltage conductor, located inside the bushing, from the grounded plane. The grounded plane can for example be a transformer tank or a wall, such as for example a High Voltage Direct Current (HVDC) valve hall wall.

In order to obtain a smoothening of the electrical potential distribution between the conductor and the grounded plane, a bushing often comprises a condenser core. A condenser core is a body which typically comprises a number of floating, coaxial foils made of a conducting material, where the foils are separated by a dielectric spacing material, which could for example be oil impregnated or resin impregnated paper. Examples of bushings comprising a condenser core are disclosed in patent document EPI 798740.

SUMMARY OF THE INVENTION

Various aspects of the invention are set out in the accompanying claims.

One embodiment provides a high voltage device for providing electrical insulation of a conductor extending through the device. The device comprises a hollow insulator; a conductor extending through the hollow insulator; and a field gradient decreasing arrangement comprising a condenser core and a voltage grading shield. The condenser core and the voltage grading shield are arranged around the conductor inside the hollow insulator in a manner so that the voltage grading shield is arranged around at least part of the condenser core. With this embodiment is achieved that a smaller condenser core may be used than in a field gradient decreasing arrangement comprising a condenser core but no voltage grading shield, while achieving the same voltage grading effect.

The condenser core typically comprises a plurality of coaxially arranged foils extending along the axial direction of the conductor, wherein at least one foil is arranged to have a potential which is, out of the potentials of the plurality of foils, most similar to the potential of a flange for connecting the high voltage device to a grounded plane. Such foil(s) is often referred to as the grounded foil(s). According to one embodiment, the voltage grading shield extends beyond at least one end of the grounded foil in the axial direction of the conductor, while at least one other foil of the condenser core extends beyond the end of the voltage grading shield in the same direction. Hereby is achieved that the condenser core, as well as the voltage grading shield, contribute to the grading of the voltage towards ground outside the voltage device. Furthermore is achieved that the condenser core provides a smoothening of the electric field between the conductor and the voltage grading shield.

In another embodiment, the voltage grading shield extends beyond at least one end of the condenser core in the axial direction of the conductor. Hereby is achieved that the distribution of the electrical field, inside the voltage grading shield in the radial direction from the conductor, is mainly obtained by the condenser core, while the distribution of the electrical field towards ground outside the device is mainly obtained by the voltage grading shield.

The high voltage device may comprise a flange for connecting the high voltage device to a grounded plane. The voltage grading shield may be arranged to extend on both sides of the flange in the axial direction of the conductor, or the voltage grading shield may be confined to one side of the flange in the axial direction of the conductor. If the voltage grading shield extends on both sides of the flange, the size of the condenser core can be reduced on both sides of the flange compared to a condenser core of a field gradient decreasing arrangement having no voltage grading shield, thereby increasing the possible size reduction of the condenser core.

In one embodiment, the high voltage device comprises a high voltage shield arranged around the conductor on at least one end of the condenser core. The high voltage shield contributes to the reduction of the field gradient in the vicinity of the condenser core end. The high voltage shield could, for example, be arranged at the end of the condenser core on a side of a flange, in the axial direction of the conductor, on which the voltage grading shield extends.

The high voltage device could for example be a bushing. In one aspect, a transformer station comprises such a bushing. In another aspect, a high voltage direct current station comprises such a bushing.

Although various aspects of the invention are set out in the accompanying independent claims, other aspects of the invention include the combination of any features presented in the described embodiments and/or in the accompanying claims, and not solely the combinations explicitly set out in the accompanying claims.

DETAILED DESCRIPTION OF THE INVENTION

Figure 1:
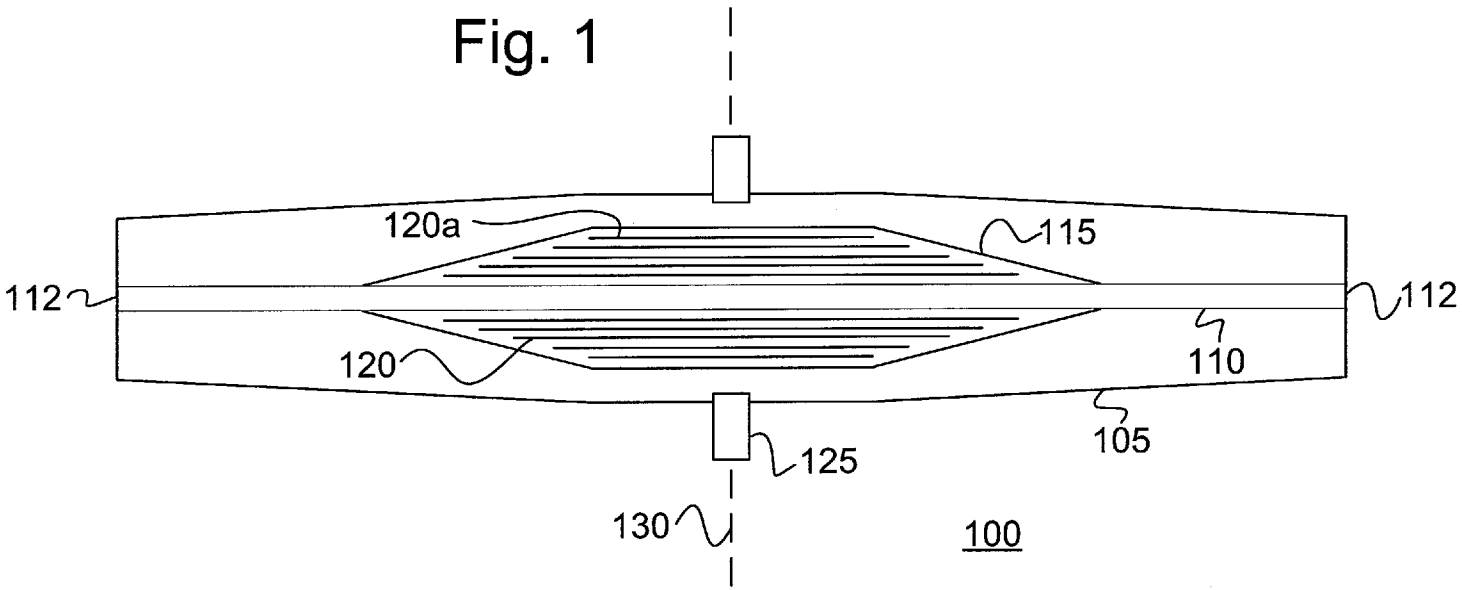
FIG. 1 is a schematic illustration of an example of a bushing having field gradient decreasing arrangement comprising a condenser core.

FIG. 1 schematically illustrates a bushing 100 comprising a hollow, elongate insulator 105 through which a conductor 110 extends. At each end of the conductor 110 is provided an electrical terminal 112 for connecting the conductor 110 to electrical devices. Bushing 100 of FIG. 1 furthermore comprises a condenser core 115.

A condenser core 115 comprises a number of foils 120 which are separated by a solid dielectric material, such as oil- or resin impregnated paper. The foils 120 are typically coaxially arranged. The foils 120 could for example be made of aluminium or other conducting material. The foils 120 could be integrated with the dielectric material, for example as conductive ink on paper, or separate from the dielectric material. The foils 120 and the separating dielectric material can for example be wound into the desired shape. A condenser core 115 can for example be in the shape of a cylinder, or of a cylinder having a conical end part as shown in FIG. 1, etc. Typically, the axial length of an outer foil 120 is smaller than the axial length of an inner foil 120 in order to maintain a similar area of the different foils 120 in a condenser core 115. Thus, a conical end part of the condenser core 115 is often practical.

The foil(s) 120 that will have a potential that is most similar to that of the grounded plane 130 when the bushing 100 is in use will hereinafter be referred to as the grounded foil 120*a* (although the grounded foil 120*a* does not have to be at ground potential). The grounded foil 120*a* is often the outermost foil(s) of a condenser core 115.

The bushing of FIG. 1 further comprises a flange 125 to which the insulator 105 is attached. The flange 125 can be used for connecting the bushing 100 to a plane 130 through which the conductor 110 is to extend, such a plane 130 of the referred to as the grounded plane. It should be noted that the grounded plane 130 does not have to be connected to ground, but may have a potential which differs from ground. However, the term grounded plane will hereinafter be used for ease of description.

When the bushing 100 is in use, the condenser core 115 acts as a voltage divider and distributes the field along the length of the insulator 110, thereby providing a smoothening of the electrical potential distribution. The higher the potential difference between the conductor 110 and the grounded plane 130, the larger is the size of the condenser core 115 that would conventionally be required in order to achieve efficient smoothening of the electrical potential distribution.

Figure 2:
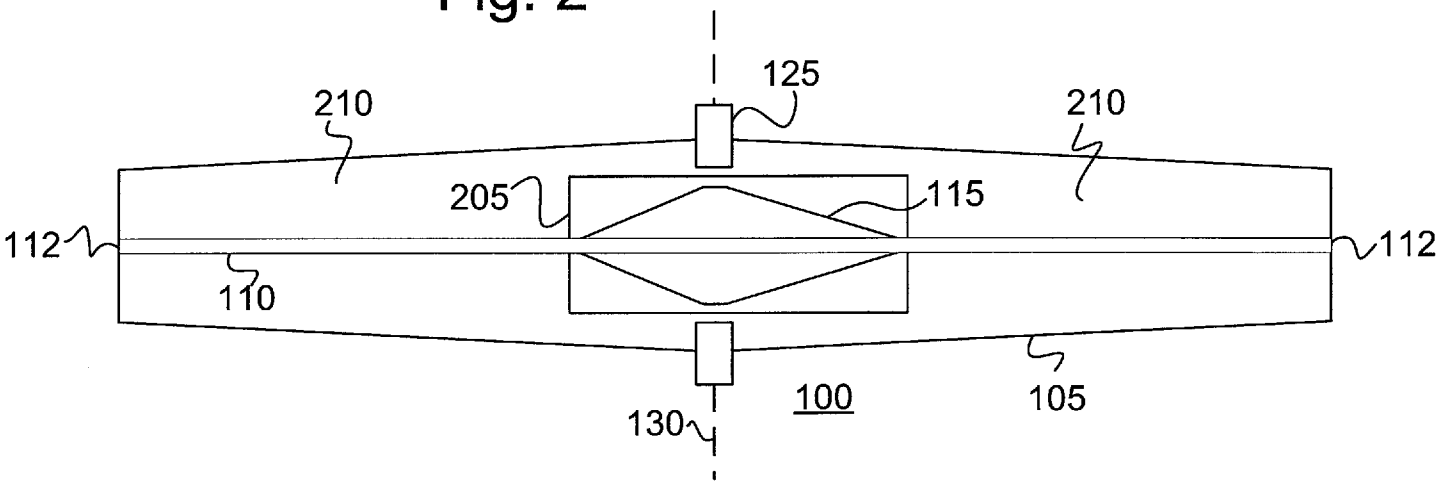
FIG. 2 is a schematic illustration of an example of a bushing having a field gradient decreasing arrangement comprising a condenser core and a voltage grading shield.

In FIG. 2, an alternative embodiment of a bushing 100 is schematically illustrated. The bushing 100 of FIG. 2 comprises a field gradient decreasing arrangement comprising a condenser core 115 in combination with a voltage grading shield 205 which is arranged around at least part of the condenser core 115 and the conductor 110 inside the hollow insulator 105. The voltage grading shield 205 is arranged to have a potential similar to, or the same potential as, the flange 125 (and hence a potential similar to, or the same as, the grounded plane 130 when the bushing 100 is in use). Thus, using a similar terminology as for the grounded foil 120*a* and the grounded plane 130, a voltage grading shield 205 could be referred to as a grounded voltage grading shield 205. The voltage grading shield 205 and the condenser core 115 could advantageously be coaxially arranged.

The bushing 100 of FIG. 2 could for example be used as a wall bushing. A wall bushing is typically used in applications where both sides of the grounded plane 130 are in contact with air, such as when a conductor 110 is to extend through a wall of a HVDC valve hall. A wall bushing could therefore be said to have two air side parts 210.

By using a combination of a condenser core 115 and a voltage grading shield 205 as a field gradient decreasing arrangement in a bushing 100, the field gradient decreasing demands on the condenser core 115 will be reduced, since the voltage grading shield 205 provides geometrical field gradient reduction around at least one side of the grounded plane 130. Thus, part of the smoothening of the electrical potential distribution is achieved by the condenser core 115, and part by the voltage grading shield 205. Hence, the size of a condenser core 115 required for a certain potential difference between the conductor 110 and the grounded plane 130 will be smaller than the corresponding size of a condenser core 115 in a bushing 100 which does not include a voltage grading shield 205. Thus, the condenser core 115 of such a field gradient decreasing arrangement may be down-sized compared to a condenser core 115 of a conventional field gradient decreasing arrangement comprising a condenser core 115 and no voltage grading shield.

Figure 3:
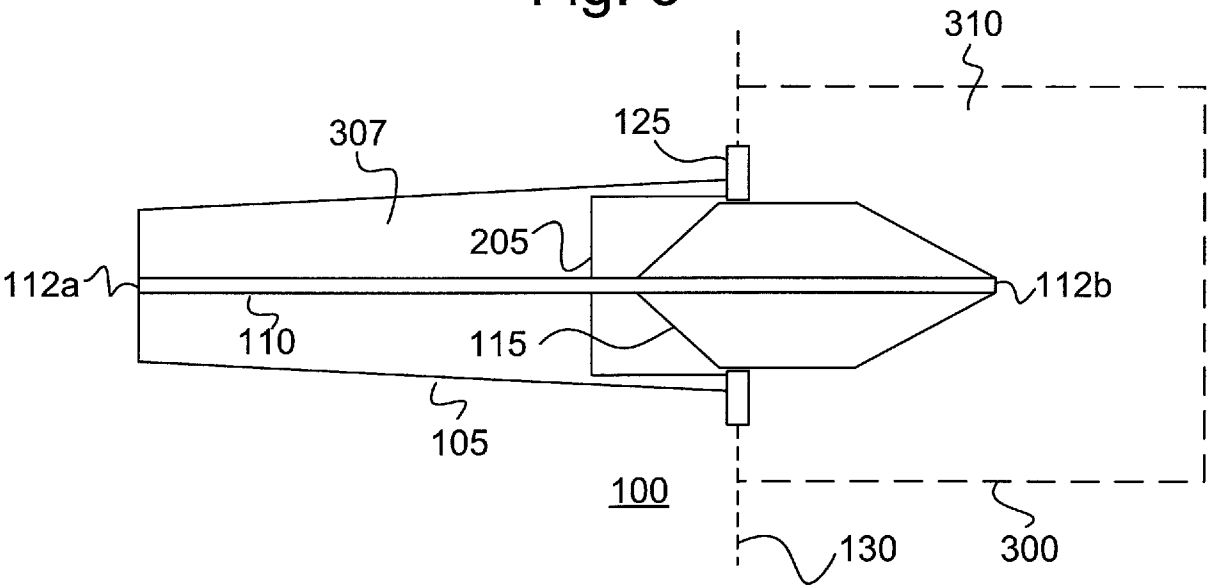
FIG. 3 is a schematic illustration of another example of a bushing having a field gradient decreasing arrangement comprising a condenser core and a voltage grading shield.

An example of a bushing 100 according to another embodiment is schematically illustrated in FIG. 3. The bushing 100 of FIG. 3 is suitable for use as a transformer bushing, in which case the grounded plane 130, from which the bushing 100 provides isolation to the conductor 110, will be a transformer tank 300. The bushing 100 of FIG. 3 can extend from the air at the outside of a transformer tank 300 into the transformer tank 300. The bushing 100 of FIG. 3 is arranged to be attached to the transformer tank 300 by means of a flange 125, the flange 125 thus separating the bushing into an air side part 307 on the air side of the bushing 100 and a transformer side part 310 on the transformer side of the bushing 100. In the bushing 100 of FIG. 3, a hollow insulator 105 extends mainly on the air-side of the flange 125. The transformer side part 310 of the bushing 100 of FIG. 3 will typically be immersed in transformer oil or other electrically insulating substance used in transformers. The bushing 100 of FIG. 3 could alternatively be used in other surroundings, so that the air side part 307 of bushing 100 is in contact with something other than air, and/or so that the transformer side part 310 is in contact with something other than transformer oil. At the air side end of the conductor 110 of bushing 100 of FIG. 3 is provided an electrical terminal 112*a* for connection of the conductor 110 to other electrical devices. On the transformer side end of the conductor 110 is provided an electrical terminal 112*b* for connection of the conductor 110 to the transformer windings.

Bushing 100 of FIG. 3 comprises a field gradient decreasing arrangement comprising a condenser core 115 arranged in conjunction with a voltage grading shield 205. In the bushing 100 of FIG. 3, the voltage grading shield 205 extends from the flange 125 into the air side part 307 of the bushing only. However, in another implementation, the voltage grading shield 205 could extend into both the air side part 307 and the transformer side part 310 of the bushing.

As discussed above, the use of a voltage grading shield 205 in combination with a condenser core 115 reduces the voltage grading demands on a condenser core 115, thus allowing for down-sizing of the condenser core 115. The size of the condenser core 115 of FIG. 3 is considerably reduced on the air-side part 307 of the bushing 100, where the voltage grading shield 205 is present, as compared to a conventional condenser core design for a similar purpose, whereas the size of the condenser core 115 on the transformer side part 310 of bushing 100 of FIG. 3 basically corresponds to the size of the transformer side part of a condenser core 115 of a conventional bushing.

A voltage grading shield 205 could be made of a conducting material such as metal, for example aluminium, or of plastic coated with conductive paint, or of any other suitable at least partly conductive structure. A voltage grading shield 205 could for example be in the shape of a tube or throat shield, and could for example be manufactured from rolled out metal, by means of pressure turning of a metal, casting of a metal, casting of plastic, or in any other suitable way.

Figure 4:
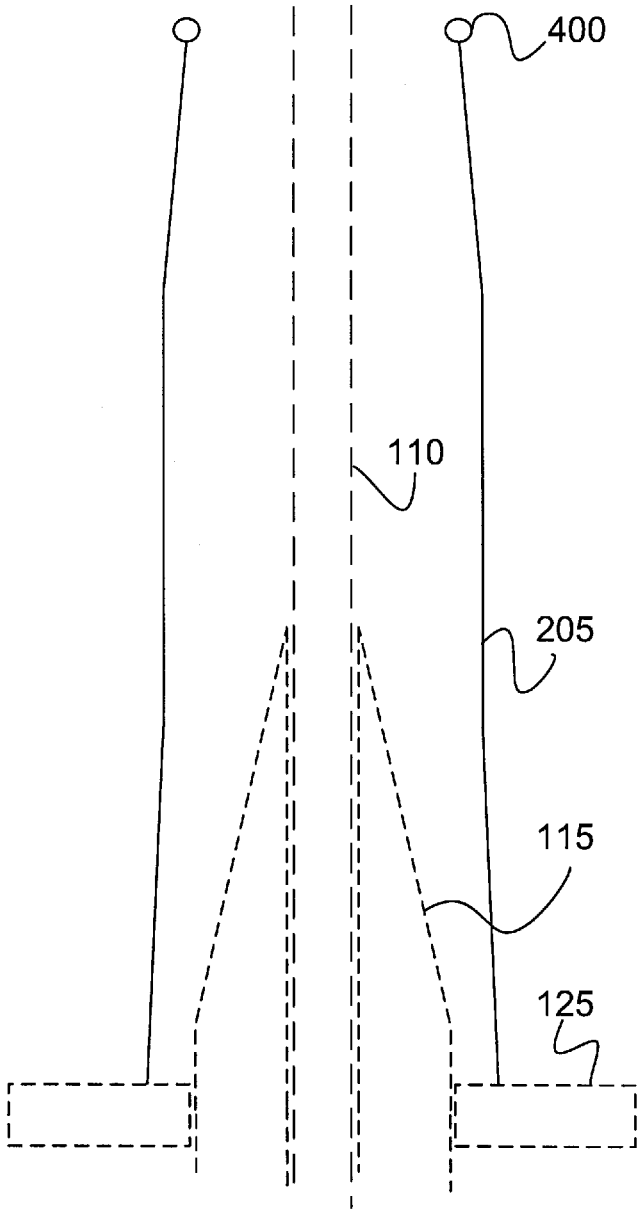
FIG. 4 is schematic illustration of an example of a voltage grading shield.

An example of a voltage grading shield 205 is shown in FIG. 4. A voltage grading shield 205 which extends into both sides of a flange 125 of a bushing 100 could be manufactured as a single part, or as two or more parts as described in WO2008/027004. A voltage grading shield 205 could advantageously be of a rotationally symmetrical shape. It could for example be shaped as a cylinder, it could have convex parts, it could be shaped as a cylinder with one or more conical parts as is illustrated in FIG. 4, etc. An end of a voltage grading shield 205 which is arranged to face away from the grounded plane 130 could advantageously have a rounded edge 400, in order to ensure a smooth potential distribution around the edge 400.

Besides providing a smoothening of the electrical field, a condenser core 115 acts as a mechanical support to the conductor 110 of a bushing 100, so that an adequate clearance is ensured between the conductor 110 and any parts of the bushing 100 for which a clearance from the conductor 110 is required (for example the insulator 105 and the voltage grading shield 205), even in case of earth quakes or other mechanical stress applied to the bushing 100. A down-sized condenser core 115, which in combination with a voltage grading shield 205 provides sufficient field gradient reduction, generally also provides efficient mechanical support to the conductor 110.

A field gradient decreasing arrangement comprising a condenser core 115 and a voltage grading shield 205 will have less weight than a field gradient decreasing arrangement used to achieve the same field gradient reduction and consisting of a condenser core 115 and no voltage grading shield 205, since the condenser core 115 used in combination with the voltage grading shield 205 can be made considerably smaller. Thus, the combination of a smaller condenser core 115 and a voltage grading shield 205 will generate less mechanical stress on a grounded plane 130 to which it will be attached. Moreover, the transportation of a bushing 100 having a field gradient decreasing arrangement comprising a condenser core 115 in combination with a voltage grading shield 205 is less demanding in terms of fuel consumption and ease to handle.

Moreover, the manufacturing of a smaller condenser core 115 is generally easier and quicker than the manufacturing of a larger condenser core 115. The tools used in the manufacturing process of large condenser cores 115 typically need to be inconveniently large. Furthermore, the time required for the manufacturing of resin impregnated condenser cores 115 increases with increasing size, since the curing time of the resin (e.g. epoxy) increases with the volume of the condenser core. Thus, since the condenser core 115 can be considerably smaller when combined with a voltage grading shield 205, the manufacturing of a bushing 100 having a field gradient decreasing arrangement comprising a condenser core 115 in combination with a voltage grading shield 205 can be made easier and quicker than the manufacturing of a bushing 100 having a field gradient decreasing arrangement with a condenser core 115 and no voltage grading shield 205.

As mentioned above, the hollow insulator 105 of an air side of a bushing 100 can for example contain a gas having good dielectric and thermal properties, such as $SF_6$. Alternatively, a gel or a liquid, such as oil, may fully or partly replace the gas as a filling medium. The gas, gel or liquid which the hollow insulator 105 contains typically provides electrical insulation, as well as thermal cooling, of the conductor 110. If the condenser core 115 comprises oil impregnated dielectric material and the hollow insulator 105 contains gas, a barrier which prevents the gas and the oil to mix could be arranged around the condenser core 115. Such barrier could for example be made of a polymeric material such as epoxy.

Since the axial length of the condenser core 115 can be reduced when the condenser core 115 is combined with a voltage grading shield 205, the thermal cooling of the conductor 110 can be improved compared to a bushing 100 having the same field gradient decreasing properties but no voltage grading shield 205. The gas, gel or liquid that occupies the space inside the hollow insulator 105 can transfer more heat, since it will access a greater part of the conductor 110 when the condenser core 115 is smaller. The cooling effect of the gas, gel or liquid is thus improved.

The voltage grading shield 205 and the condenser core 115 could for example be attached to the flange 125. Alternatively, the voltage grading shield 205 could be manufactured as an integrated part of the flange 125. The voltage grading shield 205 could adjoin the grounded foil 120*a* of the condenser core 115, or the voltage grading shield 205 could be arranged so that there is a gap between the voltage grading shield 205 and the condenser core 115.

The combination of a condenser core 115 and a voltage grading shield 205 can also provide advantages over a bushing having a voltage grading shield 205 and no condenser core 115.

The flange 125 and the condenser core 115 can jointly provide efficient separation of the two parts of the bushing 100 extending on both sides of flange 125. Thus, the filling media surrounding on the respective sides of the flange 125 can efficiently be separated, without the need for any additional barrier. For example, in a transformer bushing 100 wherein the condenser core 115 is surrounded by $SF_6$ at the air side part 307 of the bushing and by transformer oil at the transformer side part 310, the condenser core 115 may efficiently separate the $SF_6$ from the transformer oil. A seal may be applied between the flange 125 and the condenser core 115 to improve the sealing effect.

Since the condenser core 115 mechanically stabilizes the conductor 110, a conductor 110 of smaller diameter could be used than in a bushing 100 with no condenser core 115, allowing for a smaller diameter of the bushing 100.

Also, when the conductor 110 is surrounded by a condenser core 115, the smoothness requirements on the conductor 110 are reduced at the part of the conductor 110 covered by the condenser core 115. The dielectric strength of a dielectric gas, such as $SF_6$, is highly sensitive to non-homogeneities in the surfaces with which the gas is in contact. However, if a conductor joint is covered by the condenser core 115, the risk of reduction of dielectric performance of the gas is eliminated. Hence, two or more conductor pieces can be joined together, in a manner so that the joint(s) are hidden under the condenser core 115, thus facilitating the manufacturing of a bushing 100 comprising a dielectric gas. In a bushing 100 where no condenser core 115 is present and wherein the insulator is filled with a gas such as $SF_6$, the sensitivity of the gas limits the acceptable roughness of the conductor 110, and it will generally be difficult to introduce joints on the conductor 110.

Figure 5A:
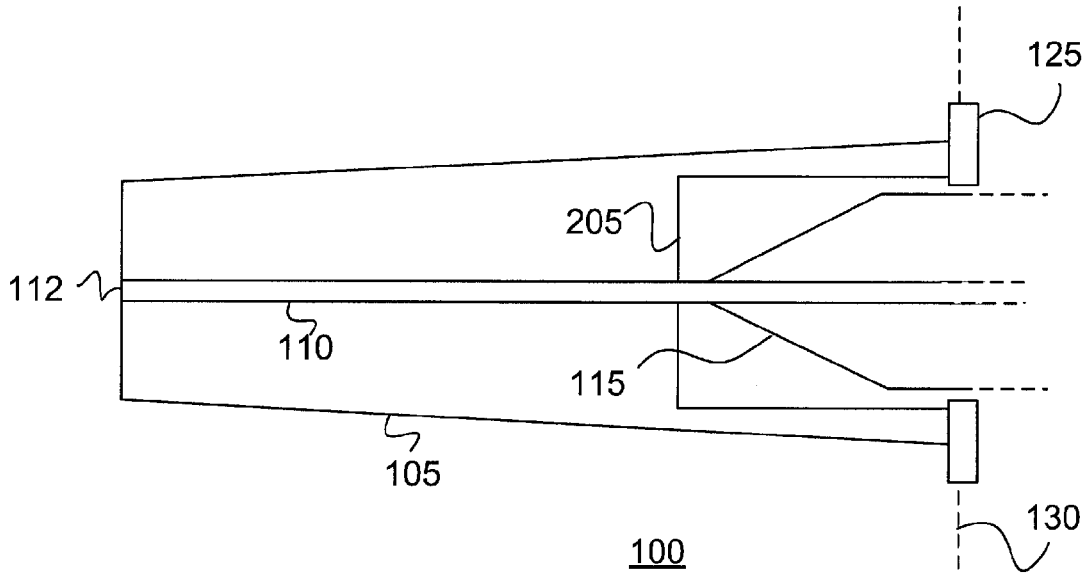
FIG. 5*a* is a schematic illustration of an example of a bushing wherein the voltage grading shield extends beyond the condenser core in the axial direction of the conductor on at at least one end of the condenser core.
Figure 5B:
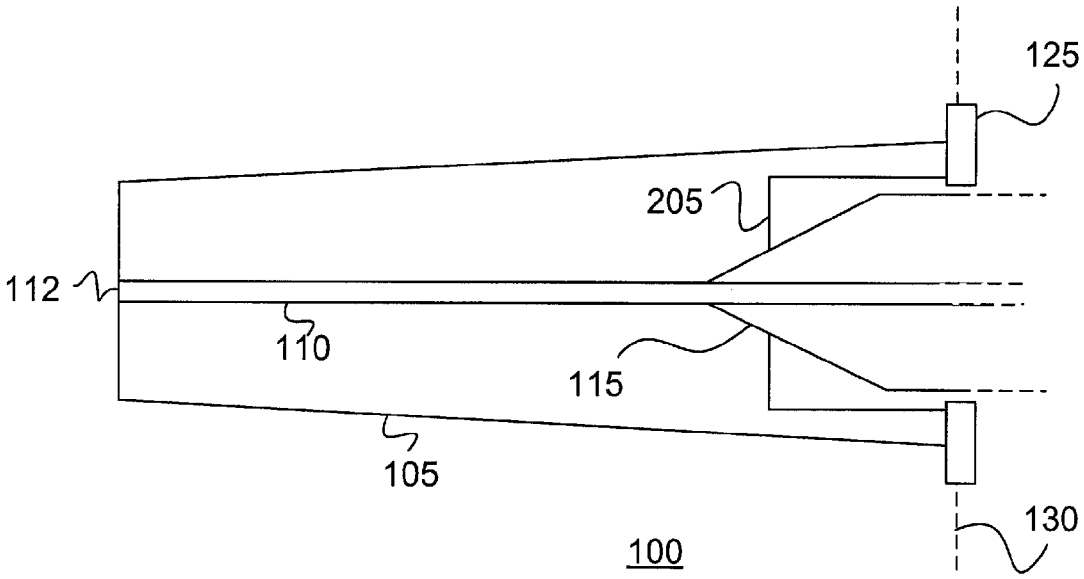
FIG. 5*b* is a schematic illustration of example of a bushing wherein the voltage grading shield is shorter than the condenser core in the axial direction of the conductor while the voltage grading shield extends beyond the grounded foil in the axial direction of the conductor at least one end of the condenser core.

One side of different examples of a bushing 100 having a field gradient decreasing arrangement comprising a condenser core 115 and a voltage grading shield 205 are schematically shown in FIGS. 5*a* and 5*b*. The bushings 100 of FIGS. 5*a* and 5*b* could for example be wall bushings or transformer bushings of which one side is illustrated. In FIG. 5*a*, the voltage grading shield 205 extends beyond the condenser core 115 in the axial direction of the conductor 110. In this embodiment, the condenser core 115 distributes the electrical field in a smooth manner in the region between the conductor 110 and the voltage grading shield 205, while the voltage grading towards the outside of the bushing 100 is mainly achieved by the voltage grading shield 205. Hence, the distribution of the electrical field in the radial direction of the conductor 110 inside the voltage grading shield 205 is mainly obtained by the condenser core 115, while the distribution towards ground outside the bushing 100 is mainly obtained by the voltage grading shield 115. The smoothening of the electrical field between the conductor 110 and the voltage grading shield 205 which is achieved by the condenser core 115 ensures that the electrical stress on the conductor 110 is reduced. Thereby, less considerations regarding the resistance of the conductor 110 to electrical stress will have to be made, and a conductor 110 of smaller diameter could generally be used, if desired, compared to a bushing 100 wherein no condenser core 115 is present.

In FIG. 5*b*, the voltage grading shield 205 extends beyond the grounded foil 120*a* of the condenser core in the axial direction of the conductor 110, but part of the condenser core 115 extends beyond the voltage grading shield 205 in this direction. The condenser core 115 achieves a smoothening of the electric field between the conductor 110 and the voltage grading shield 205 also in this embodiment. Furthermore, the condenser core 115, as well as the voltage grading shield 205, contributes to the grading of the voltage towards the outside of the bushing 100. Although not shown, the voltage grading shield 205 of the bushings 100 illustrated in FIGS. 5*a* and 5*b* could have a rounded edge 400 as shown in FIG. 4.

By applying a voltage grading shield 205 in conjunction with a condenser core 115 in order to achieve efficient field gradient reduction, the length of the condenser core 115 can be considerably reduced as compared to a condenser core 115 of a bushing wherein no voltage grading shield 205 is present. Reductions in length of typically 10-20%, or more, are foreseen. The length of the grounded foil 120*a* could be considerably reduced compared to a conventional condenser core 115, for example in a manner so that the grounded foil 120*a* does not considerably extend beyond an electrical connection between the grounded foil 120*a* and the flange 125 (or other part of the bushing 100 having a potential which is suitable for the grounded foil 120*a*). Alternatively, the grounded foil 120*a* could extend beyond such electrical connection. The axial length of the condenser core 115 could be reduced by the length reduction of the grounded foil 120*a*, plus a length reduction of the rest of the foils 120 made possible as a consequence of the length reduction of the grounded foil 120*a* (typically, a similar area of the different foils 120 of a condenser core 115 is desired). However, condenser cores 115 of greater length may alternatively be used.

Figure 6:
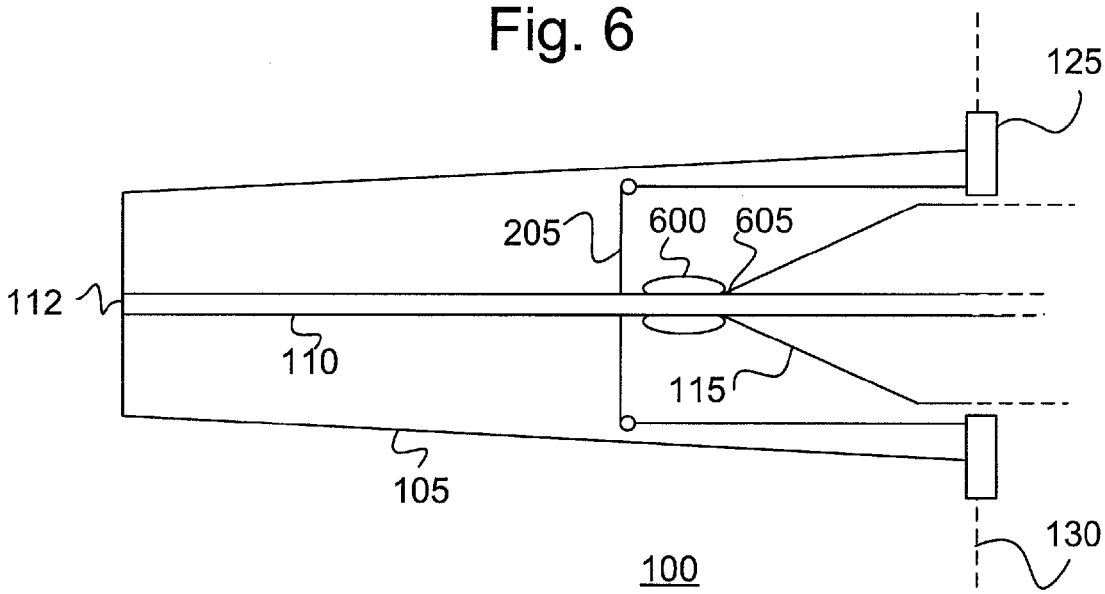
FIG. 6 is a schematic illustration of an example of a bushing comprising a high voltage shield arranged at one end of the condenser core.

In order to improve the field gradient around the end of condenser core 115, a high voltage shield could be applied. This is shown in FIG. 6, wherein one side of a bushing 100 having a high voltage shield 600 is schematically illustrated. The high voltage shield 600 of FIG. 6 is arranged at an end 605 of the condenser core 115, and provides a reduction of the field on the condenser core end 605. The high voltage shield 600 could for example be made of a suitable metal, such as aluminum, or of other conducting material. The high voltage shield 600 could for example be attached to the condenser core 115 or the conductor 110. The high voltage shield 600 could advantageously be of a rotational symmetrical shape having a smooth surface facing away from the conductor 110. The high voltage shield 600 could for example be a ring surrounding the conductor 110, or the high voltage shield 600 could be of an elongated ring shape wherein the inner circumference of the ring is flat and adjoins the conductor 110 as illustrated in FIG. 6, etc. In the bushing 100 illustrated in FIG. 6, the voltage grading shield 205 extends beyond the voltage grading shield 600 in the axial direction of the conductor 110. A high voltage shield 600 could also be arranged at an end 605 of a condenser core 115 that extends beyond the voltage grading shield 205.

The voltage grading shield 205 and the grounded foil 120*a* of the condenser core 115 could for example be arranged to be at the same electrical potential, which could be the same potential as the flange 125, and thereby of the grounded plane 130 when the bushing 100 is in use. However, the voltage grading shield 205 and the grounded foil 120*a* could alternatively be connected at different potentials. For example, the grounded foil 120*a*, or the voltage grading shield 205, or both, could be connected to a measurement point electrically separated from the potential of the flange 125.

In FIGS. 1-6, the hollow insulator 105 has been shown to be of conical shape in FIGS. 1-6. However, the hollow insulator 105 could be shaped in any suitable manner, for example as a cylinder, as a cylinder with conical end(s), etc.

The above description has been made in terms of high voltage bushings for insulation of a conductor 110. However, a field gradient decreasing arrangement comprising a combination of a condenser core 115 and a voltage grading shield 205 as described above may also be used in other devices for insulation of a high voltage conductor 110, not always referred to as bushings. Such field gradient decreasing arrangement could for example be useful in a high voltage cable interface, or in a gas-insulated switchgear interface for interfacing a gas insulated switchgear to for example a transformer, etc. A high voltage device comprising such a field gradient decreasing arrangement could comprise what in the above description has been referred to as an air side part 210, 307, wherein the air side part 210, 307 could be connected to for example a cable or a gas insulated switchgear, instead of being connected to another air side part 210 (as in FIG. 2) or to a transformer side part 310 (as in FIG. 3).

One skilled in the art will appreciate that the technology presented herein is not limited to the embodiments disclosed in the accompanying drawings and the foregoing detailed description, which are presented for purposes of illustration only, but it can be implemented in a number of different ways, and it is defined by the following claims.

What is claimed is:

1. A high voltage device for providing electrical insulation of a conductor extending through the device, the device comprising:

a hollow insulator;

a conductor extending through the hollow insulator;

a field gradient decreasing arrangement comprising a condenser core and a voltage grading shield, the condenser core and the voltage grading shield being arranged around the conductor inside the hollow insulator in a manner so that the voltage grading shield is arranged around at least part of the condenser core.

2. The high voltage device of claim 1, further comprising a flange for connecting the high voltage device to a grounded plane; wherein the condenser core comprises a plurality of coaxially arranged foils extending along the axial direction of the conductor, wherein at least one foil is arranged to have a potential which is, out of the potentials of the plurality of foils, most similar to the potential of the flange; and wherein the voltage grading shield extends, in the axial direction of the conductor, beyond at least one end of the at least one foil(s) arranged to have a potential that is most similar to the potential of the flange.

3. The high voltage device of claim 1, wherein the voltage grading shield extends beyond at least one end of the condenser core in the axial direction of the conductor.

4. The high voltage device of claim 1, further comprising a high voltage shield arranged around the conductor at at least one end of the con-denser core.

5. The high voltage device of claim 1, further comprising a flange for connecting the high voltage device to a grounded plane; wherein the voltage grading shield is arranged to extend on both sides of the flange in the axial direction of the conductor.

6. The high voltage device of claim 1, further comprising a flange for connecting the high voltage device to a grounded plane; wherein the voltage grading shield is confined to one side of the flange in the axial direction of the conductor.

7. The high voltage device of claim 5, wherein the voltage grading shield is electrically connected to the flange.

8. The high voltage bushing of claim 1, wherein the hollow insulator contains an insulating gas, such as $SF_6$.

9. The high voltage device of claim 1, wherein the condenser core comprises resin impregnated paper providing insulation between foils.

10. The high voltage device of claim 1 wherein the high voltage device is a bushing, such as a wall bushing or a trans-former bushing.

11. A transformer station comprising a device according to claim 1.

12. A High Voltage Direct Current station comprising a device according to claim 1.

* * * * *